United States Patent [19]

Montagnan

[11] Patent Number: 4,467,587

[45] Date of Patent: Aug. 28, 1984

[54] COMPONENT TO BE EMPLOYED IN THE CONSTRUCTIION OF WALLS POURED IN THE GROUND, WALL INCORPORATING SUCH A COMPONENT, AND METHOD OF CONSTRUCTING SUCH A WALL

[75] Inventor: Jean-Daniel Montagnan, Rueil Malmaison, France

[73] Assignee: Soletanche, Nanterre, France

[21] Appl. No.: 387,003

[22] Filed: Jun. 10, 1982

[30] Foreign Application Priority Data

May 14, 1982 [FR] France ..... 82 08465

[51] Int. Cl.[3] ..... E04G 21/00; E02D 5/20

[52] U.S. Cl. ..... 52/169.14; 52/742

[58] Field of Search ..... 52/742, 746, 249, 267, 52/269, 224, 169.7, 169.5, 169.14

[56] References Cited

U.S. PATENT DOCUMENTS

| | | | |
|---|---|---|---|
| 2,083,491 | 6/1937 | Chaffee | 52/269 |
| 2,816,323 | 12/1957 | Munger | 52/309.17 |
| 3,340,126 | 9/1967 | Knight | 52/249 |
| 3,404,500 | 10/1968 | Akita et al. | 52/267 |
| 3,446,888 | 5/1969 | Crowley | 52/741 |
| 3,464,175 | 9/1979 | Akita et al. | 52/249 |
| 3,820,344 | 6/1974 | Caron et al. | 405/267 |

FOREIGN PATENT DOCUMENTS 2362972 3/1978 France .

*Primary Examiner*—James L. Ridgill, Jr.
*Attorney, Agent, or Firm*—Robert Scobey

[57] ABSTRACT

Prefabricated concrete component to be employed in the construction of walls poured in the ground. It has a sheet (2) of impermeable material that at least partly covers the excavation side (6) of the wall, which is to be left uncovered after the wall has been poured, that has at least one face that forms the excavation-side face of the panel while the other side has projections (3) cast into the concrete (1) that makes up the panel, and that can be attached impermeably to the sheet on an adjacent panel.

2 Claims, 3 Drawing Figures

Figure 1:
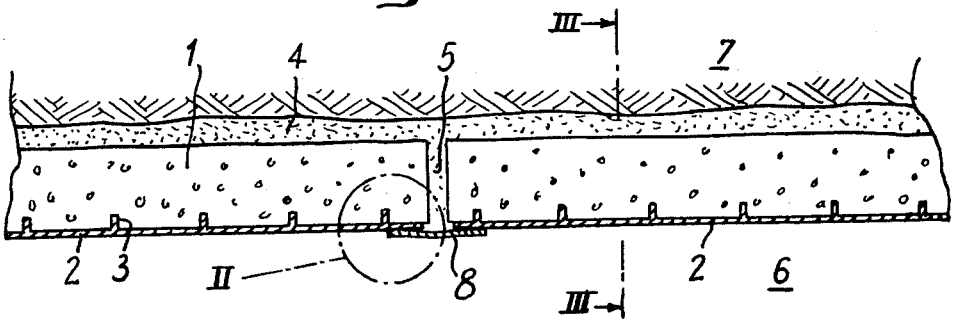

COMPONENT TO BE EMPLOYED IN THE CONSTRUCTIION OF WALLS POURED IN THE GROUND, WALL INCORPORATING SUCH A COMPONENT, AND METHOD OF CONSTRUCTING SUCH A WALL

One object of the invention is a prefabricated concrete component to be employed in the construction of walls poured in the ground.

Many methods of constructing walls poured in the soil are known in which the prefabricated components of the walls are for example sealed inside a trench to form adjacent panels, the soil to one side of the trench, called the excavation side, being subsequently excavated while the soil to the other side is left in place, where it is held back by the resulting wall.

It is often important and sometimes even essential that such walls be impermeable, which entails the problem of the tightness of the joint between two panels.

Different solutions to this problem, like that in French Pat. No. 76.25673 for example, have already been proposed. They generally employ a flexible device called a water stop to join two adjacent panels. In horizontal section, such water stops are shaped like a dumbbell with expanded ends that fit into appropriately shaped grooves in the component slab.

Some of these ends are already full and others must be expanded by inflation. Other water stops have accordion pleats in the stalk between the two inflated ends, which allows play between the two panels.

Although all these devices are relatively effective, there are sometimes drawbacks to them, especially when the pressure of outside water is significant, more than 1 kilogram (10 meters of load) for example.

Water stops have also been observed to rip, especially at the bottom of, and as a result of the motion of, the panels.

Furthermore, the expanded ends of the water stop are sealed into the groove in the slab of the concrete panel, the connection being ensured by the grout in which the wall is immersed. It has now been discovered that preferential creep sometimes occurs between the water stop and the wall of the groove in spite of the surrounding grout or even because it has been expelled.

Finally, there is an inherent drawback to this type of seal in that, since concrete itself is porous, water will be able to penetrate the main part of the panel even though the joints themselves are well sealed.

Now, in certain cases of sub-soil construction like tunnels for electrified trains, telephone central offices, and electric power substations absolute dryness, a condition that is practically impossible to attain by known methods, is essential.

The present invention avoids these problems and provides prefabricated components for walls that can be poured in the ground while remaining absolutely impermeable not only at the joints but also at the panels themselves.

The invention is a prefabricated concrete component to be employed in the construction of walls poured in the ground, characterized by a sheet of impermeable material that at least partly covers the excavation side of the wall, which is to be left uncovered after the wall has been poured, that has at least one face that forms the excavation-side face of the panel while the other side has projections cast into the concrete that makes up the panel, and that can be attached impermeably to the sheet on an adjacent panel.

This sheet of impermeable material can be made of any appropriate material like rubber or plastic with the projections in the form of ribs or discrete anchoring points.

These projections rigidly attach the sheet to the panel while it is being cast. The sheet is therefore cut to fit the dimensions of the mold so that it will cover the desired surface area of the component. Concrete is then poured into the mold in such a way that the projections on the sheet will firmly attach it to the exterior of the component.

A sheet is selected that will adequately resist the pressure of the surrounding ground and with projections that are dimensioned and distributed to ensure an attachment that will prevent such pressure in relation to the porosity of the concrete from detaching the impermeable sheet from the component.

Finally, the sheet must also be resistant enough to resist damage while being embanked and when the coat of hardened grout that covers it is removed.

The sheets will ensure the impermeability of the components as such while the attachment between two sheets on adjacent components will ensure the impermeability of the joint between the components.

Another advantage of the invention is that the impermeable sheet may be sculptured or painted to enhance the appearance of the wall.

The impermeable sheet may also extend from the top to the bottom of the wall or only down as far as the excavation side is exposed.

In particular, when the component in accordance with the invention extends below a foundation floor that is then constructed on the excavation side, the sheet needs to be extended only down to below the floor to ensure tightness between it and the sheet.

In one particular embodiment of the invention the impermeable sheet needs to extend only along the edges of the component. Such a sheet can be a strip with ribs or anchoring points of the type described above to attach it to the concrete. One advantage of this solution is that, since it does not require as much impermeable material, it costs less and can be employed where complete impermeability is less essential and esthetics are not as important.

Another object of the invention is a method of constructing a wall poured in the ground in which at least two components of the type described above are positioned next to each other and their excavation side subsequently exposed by means of known techniques, characterized by a stage in which the impermeable sheets between two components are impermeably connected.

The strips can be connected with a strip of impermeable material, which may be the same as that out of which they themselves are made, glued or bonded to the adjacent edges of adjacent sheets.

Another object of the invention is a wall poured in the ground, characterized by consisting of components of the type described above.

Figure 2:
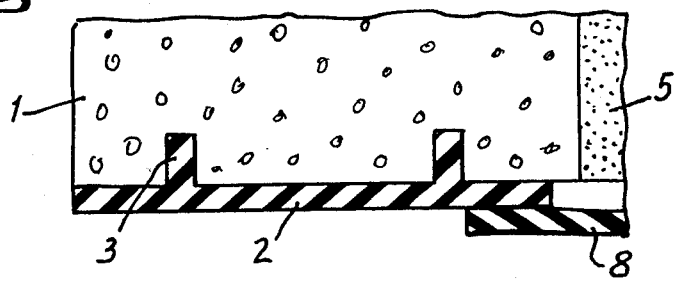
Figure 3:
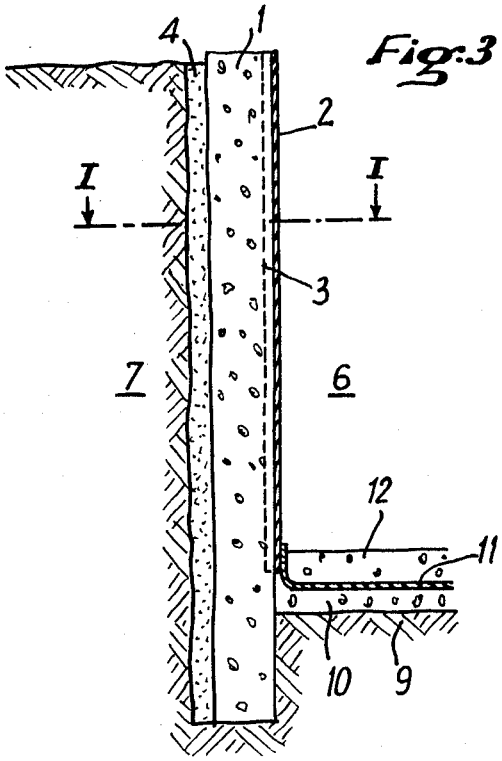

One particular embodiment of the invention will now be described as an example, but without restricting the scope of the invention in any way, with reference to the schematic drawing, in which FIG. 1 is a partial horizontal section along Line I—I in FIG. 3 of a poured wall in accordance with the invention, FIG. 2 is a larger-scale view of Detail II in FIG. 1, and FIG. 3 is a section along Line III—II in FIG. 1.

FIGS. 1 and 3 illustrate a portion of a poured wall constructed of components in accordance with the invention.

The components themselves are slabs 1 of poured concrete with an impermeable sheet 2, of rubber or plastic for example, applied to one side.

Sheet 2 has projections 3, which in this embodiment are vertical ribs.

The components in accordance with the invention are constructed by positioning a sheet 2 on the floor of the component mold with the projections 3 on the sheet facing up and then pouring in concrete 1 in such a way that, once it has set, the projections will rigidly attach the sheet to the concrete.

The components in accordance with the invention are then positioned edge to edge and separated only by a joint 5, following a known procedure, in a trench, in which they are sealed with grout 4. The excavation side 6 is then exposed, leaving the wall to hold back the ground 7.

Vertical strips 8 are then applied along joints 5 and glued or bonded along the adjacent edges of sheets 2.

Sheets 2 will thus seal panels 1 and strips 8 will seal joints 5.

In the embodiment illustrated in the drawing, the soil is not complete removed at the bottom of the wall on excavation side 6. In this case, a clean layer 10 of concrete is poured on the remaining soil 9 at the bottom of the excavation and a horizontal layer 11 of an impermeable material like rubber or plastic layed down on layer 10 and glued or bonded along the edge to the bottom of sheet 2 to ensure absolute tightness. A concrete floor 12 may then be poured in accordance with a known procedure on top of impermeable horizontal layer 11.

The scope of the invention is of course not restricted to the embodiment just described, which may be modified or varied in many ways.

Sheet 2, which is illustrated in the figures as covering all of the exposed part of concrete slabs 1 may for example be partly cut down to save impermeable material, which may be employed in strips along the edges of the panels instead of in sheets.

I claim:

1. A method of constructing an impermeable wall cast in the ground, comprising the steps of digging in the ground a trench having an excavation side and a ground side, positioning in the trench next to each other at least two prefabricated concrete components having each a sheet of impermeable material that covers fully one side of said component, with said sheet positioned on the excavation side of the trench, said sheet having its side opposite to said excavation side comprising projections cast into said concrete component, fixing said components in said trench, excavating said excavation side of the trench to expose said impermeable sheets, and interconnecting impermeably said impermeable sheets of two adjacent components.

2. A method according to claim 1, in which said interconnecting impermeably said impermeable sheets of two adjacent components is achieved by bonding a strip of impermeable material to the adjacent edges of said sheets.

* * * * *